US009784544B2

(12) United States Patent
Jones

(10) Patent No.: US 9,784,544 B2
(45) Date of Patent: Oct. 10, 2017

(54) FRANGIBLE MUNITION

(71) Applicant: BAE SYSTEMS plc, London (GB)

(72) Inventor: Matthew Jones, Monmouthshire (GB)

(73) Assignee: BAE SYSTEMS plc, London (GB)

( * ) Notice: Subject to any disclaimer, the term of this patent is extended or adjusted under 35 U.S.C. 154(b) by 0 days.

(21) Appl. No.: 14/913,040

(22) PCT Filed: Aug. 18, 2014

(86) PCT No.: PCT/GB2014/052528

§ 371 (c)(1),
(2) Date: Feb. 19, 2016

(87) PCT Pub. No.: WO2015/025143

PCT Pub. Date: Feb. 26, 2015

(65) Prior Publication Data

US 2016/0209190 A1 Jul. 21, 2016

(30) Foreign Application Priority Data

Aug. 20, 2013 (EP) ..... 13275190
Aug. 20, 2013 (GB) ..... 1314868.9

(51) Int. Cl.
*F42B 12/62* (2006.01)

(52) U.S. Cl.
CPC ..... *F42B 12/625* (2013.01)

(58) Field of Classification Search
CPC ..... F42B 12/625; F42B 12/58; F42B 12/62; F42B 12/60
USPC ..... 102/499
See application file for complete search history.

(56) References Cited

U.S. PATENT DOCUMENTS 2,421,859 A * 6/1947 Whitney ..... F42C 9/141 102/268
2,943,572 A * 7/1960 Flett ..... F42C 13/02 102/214
3,055,300 A * 9/1962 Stoehr ..... F42B 4/12 102/339

(Continued)

FOREIGN PATENT DOCUMENTS

DE 1913790 A1 10/1970
DE 3206497 A1 11/1982

(Continued)

OTHER PUBLICATIONS

International Preliminary Report on Patentability received for Patent Application No. PCT/GB2014/052528, mailed on Mar. 3, 2016. 7 pages.

(Continued)

*Primary Examiner* — Joshua Freeman
(74) *Attorney, Agent, or Firm* — Finch & Maloney PLLC

(57) ABSTRACT

The invention relates to a common carrier munition ammunition device, more particularly to common carrier payload delivery shell with a frangible ogive element.
There is provided a common carrier munition comprising a tail unit, a main body which comprises a payload cavity for receiving a payload, a fuze, and located between said main body and the fuze an frangible ogive element, wherein the tail unit and main body comprise cooperatively engaging male and female threaded portions, wherein at least one of the threads is a shearable thread.

18 Claims, 1 Drawing Sheet

(56) References Cited

U.S. PATENT DOCUMENTS

| | | | | |
|---|---|---|---|---|
| 3,677,182 | A * | 7/1972 | Peterson | F42B 12/62 102/364 |
| 3,750,575 | A | 8/1973 | Heede et al. | |
| 3,834,312 | A * | 9/1974 | Simmons | F42B 10/56 102/339 |
| 3,842,741 | A | 10/1974 | Brothers et al. | |
| 3,981,244 | A * | 9/1976 | Adimari | F42B 12/62 102/489 |
| 4,226,185 | A * | 10/1980 | Tobler | F42B 10/56 102/340 |
| 4,557,198 | A * | 12/1985 | Hickey | F42B 12/58 102/481 |
| 4,651,648 | A * | 3/1987 | Alon | F42B 10/56 102/334 |
| 4,771,696 | A * | 9/1988 | Smolnik | F42B 30/003 102/293 |
| 4,793,260 | A * | 12/1988 | Kruse | F42B 12/62 102/357 |
| 4,807,533 | A * | 2/1989 | von Entress-Fursteneck | F42B 12/62 102/476 |
| 4,833,993 | A | 5/1989 | Garcia-Garcia | |
| 4,860,659 | A * | 8/1989 | Andreetta | F42B 30/08 102/473 |
| H000959 | H * | 9/1991 | Heckman | F42B 12/625 102/357 |
| 5,107,768 | A * | 4/1992 | Langenohl | F42B 30/08 102/293 |
| 5,210,372 | A * | 5/1993 | Tripptrap | F42B 12/62 102/357 |
| 5,233,127 | A * | 8/1993 | Sauvestre | F42B 12/62 102/357 |
| 5,317,975 | A * | 6/1994 | Sauvestre | F42B 12/62 102/357 |
| 5,347,931 | A * | 9/1994 | Day | F42B 12/42 102/275.6 |
| 5,386,781 | A * | 2/1995 | Day | F42B 4/28 102/337 |
| 5,454,324 | A * | 10/1995 | Larmignat | F42B 5/155 102/334 |
| 5,684,267 | A * | 11/1997 | Dean | F42B 12/62 102/293 |
| 5,792,981 | A * | 8/1998 | Singer | F02K 9/343 102/381 |
| 6,523,478 | B1 | 2/2003 | Gonzalez et al. | |
| 6,679,177 | B1 * | 1/2004 | Wu | F42B 15/36 102/377 |
| 6,782,829 | B1 * | 8/2004 | Han | F42B 10/56 102/387 |
| 6,860,185 | B2 * | 3/2005 | Altenau | F42B 12/204 86/51 |
| 6,981,450 | B1 * | 1/2006 | Adimari | F42B 12/60 102/393 |
| 7,121,210 | B2 * | 10/2006 | Steele | F42B 12/58 102/211 |
| 7,124,690 | B1 | 10/2006 | Tadros et al. | |
| 7,360,489 | B1 | 4/2008 | Han et al. | |
| 8,601,950 | B2 * | 12/2013 | Dau | F42B 12/207 102/473 |
| 2002/0166475 | A1 | 11/2002 | Brooks et al. | |
| 2003/0116051 | A1 | 6/2003 | Kravel et al. | |
| 2003/0205161 | A1 * | 11/2003 | Roach | F42B 39/20 102/481 |
| 2004/0107860 | A1 * | 6/2004 | Loubser | F42B 12/62 102/481 |
| 2004/0134372 | A1 * | 7/2004 | Scherer | F42B 12/48 102/499 |
| 2005/0066842 | A1 | 3/2005 | Brunn et al. | |
| 2005/0223930 | A1 | 10/2005 | Bootes et al. | |
| 2007/0006767 | A1 * | 1/2007 | Brislin | F42B 12/64 102/489 |
| 2009/0151590 | A1 | 6/2009 | Dau et al. | |
| 2011/0079164 | A1 | 4/2011 | Broden et al. | |
| 2012/0044710 | A1 | 2/2012 | Jones | |
| 2012/0180686 | A1 | 7/2012 | Jones et al. | |
| 2013/0055917 | A1 | 3/2013 | Menefee, III | |
| 2013/0186295 | A1 | 7/2013 | Kravel | |
| 2013/0239838 | A1 | 9/2013 | Kravel | |
| 2013/0319278 | A1 | 12/2013 | Kravel | |
| 2014/0013985 | A1 | 1/2014 | Kravel | |
| 2016/0202031 | A1 * | 7/2016 | Rumfitt | F42B 12/64 102/334 |
| 2016/0209189 | A1 | 7/2016 | Adams | |
| 2016/0209190 | A1 * | 7/2016 | Jones | F42B 12/625 |
| 2016/0209191 | A1 * | 7/2016 | Adams | F42B 12/625 |

FOREIGN PATENT DOCUMENTS

| | | | |
|---|---|---|---|
| DE | 3339039 | A1 | 5/1985 |
| DE | 102007048074 | A1 | 4/2009 |
| EP | 0466499 | A1 | 1/1992 |
| FR | 1398715 | A | 5/1965 |
| FR | 2697328 | A1 | 4/1994 |
| FR | 2699659 | A1 | 6/1994 |
| GB | 143281 | | 5/1920 |
| GB | 1179804 | A | 2/1970 |
| GB | 1415274 | | 11/1975 |
| GB | 2105813 | A | 3/1983 |
| GB | 2274905 | A | 8/1994 |
| JP | 2011047527 | A | 3/2011 |
| WO | 2015025141 | A1 | 2/2015 |
| WO | 2015025143 | A1 | 2/2015 |
| WO | 2015025144 | A1 | 2/2015 |
| WO | 2015025145 | A1 | 2/2015 |

OTHER PUBLICATIONS

International Search Report and Written Opinion received for Patent Application No. PCT/GB2014/052530, mailed on Sep. 17, 2014. 11 pages.

GB Intellectual Property Office Search Report under Section 17(5) received for GB Patent Application No. 1314865.5 mailed Dec. 20, 2013. 4 pages.

Extended European Search Report received for EP Patent Application No. 13275187.6 mailed Jan. 29, 2014. 5 pages.

International Search Report and Written Opinion received for Patent Application No. PCT/GB2014/052526, mailed on Sep. 17, 2014. 11 pages.

GB Intellectual Property Office Search Report under Section 17(5) received for GB Patent Application No. 1314869.7 mailed Dec. 13, 2013. 6 pages.

Extended European Search Report received for EP Patent Application No. 13275188.4 mailed Feb. 4, 2014. 7 pages.

GB Intellectual Property Office Search Report under Section 17(6) received for GB Patent Application No. 1314869.7 (as it relates to claim 14) mailed Jun. 13, 2014. 3 pages.

International Search Report and Written Opinion received for Patent Application No. PCT/GB2014/052529, mailed on Sep. 17, 2014. 11 pages.

GB Intellectual Property Office Search Report under Section 17(5) received for GB Patent Application No. 1314867.1 mailed Dec. 20, 2013. 4 pages.

Extended European Search Report received for EP Patent Application No. 13275189.2 mailed Feb. 7, 2014. 6 pages.

International Preliminary Report on Patentability received for Patent Application No. PCT/GB2014/052530, mailed on Mar. 3, 2016. 7 pages.

International Preliminary Report on Patentability received for Patent Application No. PCT/GB2014/052526, mailed on Mar. 3, 2016. 7 pages.

International Preliminary Report on Patentability received for Patent Application No. PCT/GB2014/052529 mailed on Mar. 3, 2016. 7 pages.

International Search Report and Written Opinion received for Patent Application No. PCT/GB2014/052528, mailed on Sep. 17, 2014. 11 pages.

(56) References Cited

OTHER PUBLICATIONS

GB Intellectual Property Office Search Report under Section 17(5) received for GB Patent Application No. 1314868.9 mailed Dec. 20, 2013. 4 pages.
Extended European Search Report received for EP Patent Application No. 13275190.0 mailed Jan. 31, 2014. 7 pages.

* cited by examiner

FRANGIBLE MUNITION

The invention relates to a frangible munition device, more particularly to a common carrier payload delivery shell, with a frangible safety link.

There is a requirement to provide munitions that are IM compliant such that they undergo a low order event in response to a hazard event. There is also a desire that in the event of a blind, such as where a munition lands without functioning, that the munition fails in a safe mode.

According to a first aspect of the invention there is provided a frangible munition comprising a tail unit, a main body which comprises a payload cavity for receiving a payload, a fuze, and an explosive train operably connected to said fuze, located between said main body and the fuze, is a frangible ogive element, wherein the frangible ogive element and main body are retained in operable engagement by at least one frangible link, such that upon an impact, said frangible link is caused to fail; such that in the event of a blind and upon impact with the ground, said frangible link fails so as to allow venting of any pressure from any energetic events.

The frangible link may be any connection means, connector or fixing, which operably links the frangible ogive element to the main body, such that the munition is able to function in the intended designed mode, but which is severable or shearable upon application of a substantial force.

The frangible link may, such as, for example be a shearable thread or at least one shear pin which retains said main body and frangible ogive element in an operable engagement.

The use of a shearable thread allows the frangible ogive element to be reversibly operably engaged with the main body. The frangible ogive element and main body may comprise cooperatively engaging male and female threaded portions, wherein at least one of the threads is a shearable thread. The use of a shearable thread allows the frangible ogive element to be readily fitted and removed without damaging the shearable linkage.

The main body threaded portion may be manufactured from a first material, and the ogive threaded portion may be manufactured from second material, wherein the second material has a lower hardness value than the first material, such that upon an applied force, such as, for example impact with the ground after a blind, the lower hardness material readily undergoes plastic deformation such that the frangible ogive element disengages from the main body.

In a highly preferred arrangement the first material is selected from a steel alloy and the second material is selected from aluminium or alloy thereof. For gun launched munitions, such as, for example shells, the forces experienced during launch will place the shell under uniform compression, however impact with the ground, typically at an incident angle will place the frangible ogive element and main body under a tensile load or shearing load, forcing said frangible link to fail, hence allowing venting of any gaseous outputs. The failure of the frangible link may be substantial or even cause detachment of the frangible ogive element from the main body. The extent of the failure is such that if the explosive train or expulsion charge where to function, after said frangible link has failed that the output may be unconfined i.e. vented, and reduce the severity of the event. The extent of any energetic material event may be reduced such that there is a reduced pressure build up and may not cause the primary payload to be ejected from the shell, or may not cause the primary payload to function.

The payload may be any commonly used payload such as, for example high explosives, illumination, smokes, decoys, chaff or a UAV. The payload and payload cavity are selected such that they are preferably of a uniform dimension, such that any payload may be readily inserted into the uniform payload cavity of the munition. In a preferred arrangement the payload is a modular unit. This allows flexibility on logistics, that any payload may be inserted into any available carrier munition or shell. Conventional smoke and illumination payloads have bespoke shells or munitions and there is no interchangeability between munitions.

In a highly preferred arrangement the frangible ogive element may be used in combination with a tail unit that is attached to the main body by a further shearable thread.

The payload may be inserted into the payload cavity from the aft end of the munition. The payload may be slidably engaged with the payload cavity, such as for example it may have an engineering fit with payload cavity, such that the payload may be prevented from moving within a direction which is normal to the elongate axis of the munition. The payload cavity may have substantially parallel walls, which extend from the intersection of main body and tail unit up to a locking ring. To prevent movement of the payload within the cavity along the elongate axis of the munition, the locking ring may be located between the main body and said frangible ogive element, to retain said payload within the payload cavity and prevent movement. Preferably the locking ring and main body comprise cooperatively engaging threaded portions, to allow reversible locking engagement. This allows the locking ring to compensate for any tolerances in manufacture of the payload, to ensure that the payload is retained in position.

The locking ring or the main body of the shell may provide the frangible link with the frangible ogive element.

The further shearable thread allows the payload to be reversibly loaded from the aft of the main body. Prior art shells secure the tail unit to the main body with shearable pins, which irreversibly fasten the tail unit to the main body, such that once the munition is constructed the tail unit may only be removed by action of the device or by applying substantial force, to cause shearing of the pins. The use of a further shearable thread allows the tail unit to be readily fitted and removed without damaging the shearable linkage. It is therefore possible to remove the payload for routine inspection or to fill with a new payload in active theatre.

In a preferred arrangement the payload is reversibly loadable from the aft end of the main body. The provision of a threaded tail unit allows the payload to be loaded and removed from the aft end. In a highly preferred arrangement during use the payload is capable of being dispensed rearwardly from the main body, upon shearing the further shearable thread.

The frangible ogive element is a portion of the munition, typically a shell body, and may be reversibly operably engaged with the fuze and main body. Preferably the frangible ogive element, main body and tail unit are secured together by shearable threads and further shearable threads, respectively.

The frangible ogive element may have a forward end locatable with said fuze and an aft end locatable with said main body, wherein the internal diameter of the aft end of said frangible ogive element may be such that it screws down on the same thread as that of the locking ring. The locking ring secures the payload within the body of the shell.

The fuze may be any known fuze, such as those that respond to selected input or stimuli or a combination of inputs, such as, for example, mechanical actions of the projectile, such as the action of high g forces from gun launch or high spin rates from imparted spin, timed delay, either mechanical or pyrotechnic, caused by separation from the launch system, or proximity to a target. The fuze may function due to electronic activation, such as, for example, from an input from a sensor or detector from on-board said munition or external to the munition. On-board systems may be internal guidance systems. External stimuli may be provided such as, for example by fly-by wire, remote control, GPS or target activated laser guidance.

The fuze may be operably connected to an explosive train, to provide an energetic output, such as an expulsion charge or detonative output. Where the payload is delivered during flight i.e. rather than a terminal effect, the payload may be expelled from the munition by an expulsion charge. In a preferred arrangement said expulsion charge is suspended in free space within the frangible ogive element, such that it does not physically contact the payload; this allows for any errors in manufacturing tolerances between the expulsion charge and the payload. The fuze device may comprise safety and arming units (SAU), explosive trains to provide sufficient stimuli to the expulsion charge.

Where both the frangible ogive element and main body, and the main body and tail unit are fastened with shearable threaded portions and further shearable threaded portions, respectively, the further shearable threaded portion has a lower shear strength than the shearable thread, such that during the intended use of the munition the further shearable thread between the tail unit and main body fails first, so as to permit the expulsion of the charge from the aft of the main body.

According to a further aspect of the invention there is provided a method of dispensing a payload from a munition as defined herein, comprising the steps of causing initiation of the expulsion charge, causing shearing of the further shearable thread.

Whilst the invention has been described above, it extends to any inventive combination of the features set out above, or in the following description, drawings or claims.

Exemplary embodiments of the device in accordance with the invention will now be described with reference to the accompanying drawings in which.

Figure 1:
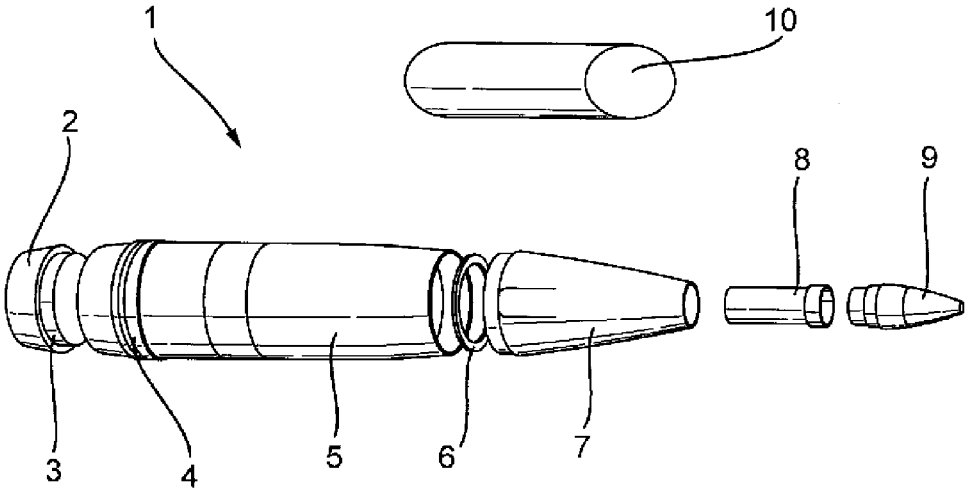
FIGS. 1 show an exploded side view of a shell according to the invention.

Turning to FIG. 1 there is provided a shell 1, with a main body 5, which is manufactured from a steel alloy. Located around the circumference of the main body 5 is a copper driving band 4, which allows engagement with the rifling on the bore of a barrel, so as to impart spin. A tail unit 2 is located at the aft of the main body 5. The tail unit 2 is made from aluminium and contains a male threaded portion 3, which engages with a reciprocal female threaded portion (not shown) located in the aft of the main body 5. The payload 10 (shown external to the shell 1), when located in the payload cavity (not shown), inside the main body, is retained in place by use of a locking ring 6, which screws into the forward end of main body 5. The frangible ogive element 7 has a frangible link 7*a*, in the form of an aluminium thread. The frangible ogive element 7 may be secured to the locking ring 6 or directly to the main body 5. The frangible ogive element receives the expulsion charge 8 and fuze 9. Upon operation of the fuze 9, the expulsion charge 8 builds up pressure within the frangible ogive element and at the bursting pressure the thread 3 shears and the payload 10 is expelled from the aft of the main body 5.

During a blind event, the shell 1 would not function as detailed above, and would hit the ground, wherein the frangible link 7*a* would be caused to fail, such that if fuze 9 did erroneously function, that the expulsion charge 8 would be at least partially vented and would not cause the payload 10 to be expelled from the shell 1.

Figure 2:
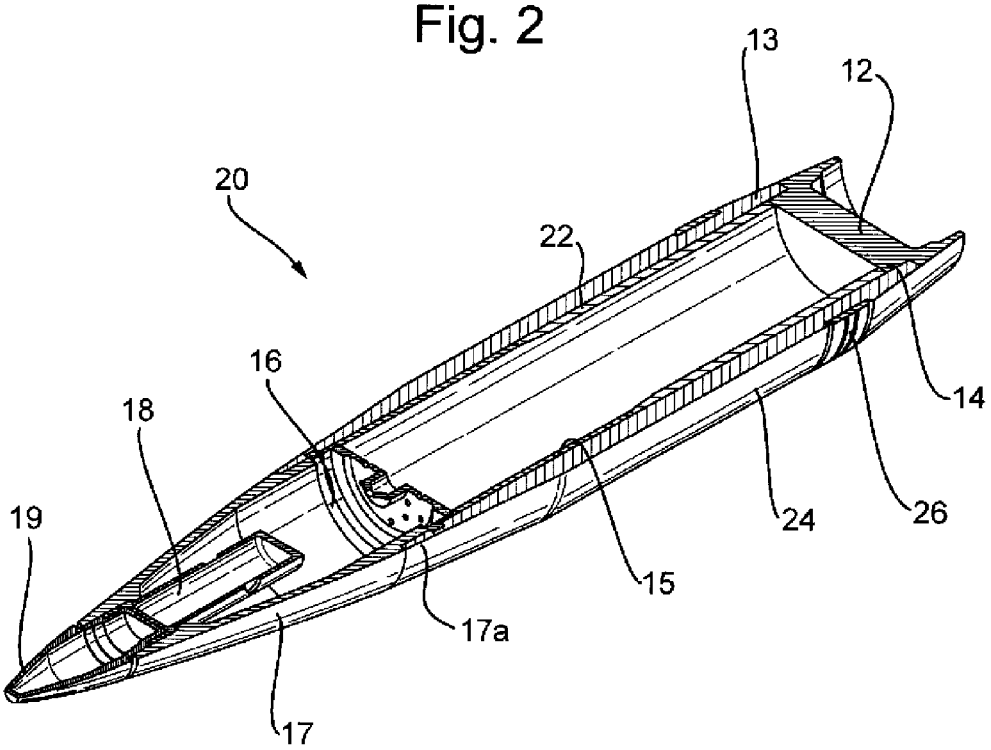
FIG. 2 shows a cross section along the axis of the shell in FIG. 1.

FIG. 2 shows an illumination shell 20, with a main body 24 formed from a steel alloy, with a driving band 26 located thereupon. A tail unit 12 is located at the aft of the main body 24. The tail unit 12 is made from aluminium and contains a male threaded portion 13, which engages with a reciprocal female threaded portion 14 located at the aft of the main body 24.

The payload 22 is located in the payload cavity 15, and is retained in place by use of a locking ring 16, which screws into the forward end of main body 24. The payload 22 is a modular illumination or smoke payload, (contents not shown) which slides into the payload cavity 15.

The frangible ogive element 17 has a frangible link 17*a*, in the form of an aluminium thread, which is fastened to the locking ring 16. The frangible ogive element receives the expulsion charge 18 and fuze 19. Upon operation of the fuze 19, the expulsion charge 18 builds up pressure within the frangible ogive element and at the bursting pressure the thread 13 shears and the payload 22 is expelled from the aft of the main body 24.

Upon operation of the fuze 19, the expulsion charge 18 builds up pressure within the frangible ogive element 17 and at the bursting pressure the thread 13 shears and the payload 22 is expelled from the aft of the main body 24.

During a blind event, the fuze 19 would not function as detailed above, and the shell 20 would hit the ground, wherein the frangible link 17*a* would be caused to fail. Therefore if the fuze 19 did erroneously function, the expulsion charge 18 would be at least partially vented via the failed frangible link and would not cause the payload 22 to be expelled from the shell 20.

The invention claimed is:

1. A frangible munition comprising:

a tail unit;

a main body which comprises a payload cavity for receiving a payload;

a fuze;

an explosive train operably connected to said fuze;

a frangible ogive element located between said main body and the fuze, wherein the frangible ogive element and main body are retained in operable engagement by at least one frangible link, such that upon an impact, said frangible link is caused to fail;

a locking ring located between the main body and said frangible ogive element, to retain said payload within the payload cavity, wherein the locking ring and main body comprise cooperatively engaging threaded portions, and wherein the frangible link of the frangible ogive element is threaded to engage the locking ring; and a further shearable portion between the main body and the tail unit having a lower shear strength than the frangible link, such that the further shearable portion between the tail unit and the main body fails prior to said frangible link being caused to fail.

2. The munition according to claim 1, wherein the frangible link is a shearable thread or at least one shear pin.

3. The munition according to claim 2, wherein the main body comprises a first threaded portion manufactured from a first material, and the frangible ogive element comprises a second threaded portion manufactured from second material, wherein the second material has a lower hardness value than the first material.

4. The munition according to claim 3, wherein the first material is selected from a steel alloy and the second material is selected from aluminium or alloy thereof.

5. The munition according to claim 1, wherein the locking ring and main body comprise cooperatively engaging threaded portions.

6. The munition according to claim 1, wherein the frangible ogive element has a forward end locatable with said fuze and an aft end locatable with said main body, wherein the internal diameter of the aft end of said frangible ogive element is substantially the same as the internal diameter of said payload cavity.

7. The munition according to claim 1, wherein the fuze is operably connected to at least one expulsion charge, wherein said charge is suspended in free space.

8. The munition according to claim 1, wherein the payload cavity has substantially parallel walls, which extend from the intersection of the tail unit to the locking ring.

9. The munition according to claim 1, wherein the payload is a modular unit.

10. The munition according to claim 9, wherein the modular unit, is reversibly loadable from the aft end of the main body.

11. The munition according to claim 2, wherein the payload is capable of being dispensed rearwardly from the main body, upon shearing the shearable thread.

12. A method of dispensing a payload from a munition according to claim 1, comprising:

causing initiation of an expulsion charge, the expulsion charge operably connected to the explosive train; and causing shearing of the shearable thread.

13. The munition according to claim 1 wherein ignition of the explosive train causes the further shearable portion between the tail unit and the main body to fail thereby allowing the payload to be dispensed rearwardly from the main body.

14. A frangible munition comprising:

a main body which comprises a payload cavity for receiving a payload;

a fuze;

an explosive train operably connected to said fuze;

a frangible ogive element located between said main body and the fuze, wherein the frangible ogive element and main body are retained in operable engagement by at least one frangible link, such that upon an impact, said frangible link is caused to fail, wherein the frangible link comprises a shearable thread;

a locking ring located between the main body and said frangible ogive element, to retain said payload within the payload cavity, wherein the locking ring and main body comprise cooperatively engaging threaded portions, and wherein the frangible link of the frangible ogive element is threaded to engage the locking ring; and a further shearable portion between the main body and the tail unit having a lower shear strength than the frangible link, such that the further shearable portion between the tail unit and the main body fails prior to said frangible link being caused to fail.

15. The munition according to claim 14, wherein the main body comprises a first threaded portion manufactured from a first material, and the frangible ogive element comprises a second threaded portion manufactured from second material, wherein the second material has a lower hardness value than the first material.

16. The munition according to claim 14, wherein the locking ring and main body comprise cooperatively engaging threaded portions.

17. The munition according to claim 14, wherein the fuze is operably connected to at least one expulsion charge, wherein said charge is suspended in free space.

18. The munition according to claim 14 wherein the payload is a modular unit, and the modular unit is reversibly loadable from the aft end of the main body.

* * * * *